US005151678A

United States Patent [19]

Veltri et al.

[11] Patent Number: 5,151,678

[45] Date of Patent: Sep. 29, 1992

[54] SAFETY BELT

[76] Inventors: Jeffrey A. Veltri; Joseph M. Souliere, both of P.O. Box 910, Thornhill, Ontario, Canada, L3P 4A5

[21] Appl. No.: 519,127

[22] Filed: May 4, 1990

[51] Int. Cl.[5] ..... G08B 23/00

[52] U.S. Cl. ..... 340/321; 340/760; 340/781; 362/103; 362/189

[58] Field of Search ..... 340/321, 760, 781; 362/102, 103, 104, 105, 108, 189

[56] References Cited

U.S. PATENT DOCUMENTS 3,153,745 10/1964 Gurian et al. ..... 340/321
3,641,333 2/1972 Gendron ..... 340/321
3,944,803 3/1976 Chao ..... 340/331
4,112,482 9/1978 Powell ..... 340/321

*Primary Examiner*—Donnie L. Crosland

[57] ABSTRACT

The apparatus relates to safety belts having a flexible support member forming the body of the belt and an electroluminescent flexible strip extending substantially the length of the belt and exposed to one side of the belt which is activated by means of a power supply connected to the electroluminescent flexible strip. This safety belt has low power requirements whereby the user can wear the belt under low light conditions for extended periods of time and be assured of adequate visible recognition.

9 Claims, 6 Drawing Sheets

SAFETY BELT

BACKGROUND OF THE INVENTION

The present invention relates to flexible illuminating safety belts and in particular to a safety belt having an electroluminescent flexible strip extending substantially the length of the belt and exposed to the exterior thereof.

The concept of lighted safety belts is well known as exemplified in U.S. Pat. No. 3,153,745, U.S. Pat. No. 2,378,075, U.S. Pat. No. 3,641,333 and U.S. Pat. No. 3,720,918. These structures are generally too complicated and difficult to manufacture and have not, to applicant's knowledge, had any success in the market place. Therefore, although the concept of a lighted safety belt appears to have significant merit with respect to the various applications such as bicycle riders, safety guards, policemen, children, swimmers, divers, etc., they have not gained wide acceptance due to the difficulty in manufacture and/or the cost of manufacture.

There remains a need to provide a simple safety belt which is illuminated to provide a highly visible light source indicating the presence of the user under low light conditions.

SUMMARY OF THE INVENTION

The safety belt according to the present invention comprises a flexible support member forming the body of the belt, an electroluminescent flexible strip extending substantially the length of the belt and exposed to one side of the belt, a power supply means connected to the electroluminescent flexible strip for exciting the same, and means for securing of the belt at various positions.

The preferred electroluminescent flexible strip only requires two contacts while providing full illumination along the length of the strip. In this way the problems associated with the prior art and particularly the difficulty to manufacture are simplified as electrical connections are only required at one end of the belt and these connections serve to provide the power to the entire length of the electroluminescent flexible strip.

According to a preferred aspect of the invention, the electroluminescent strip is continuous in the length of the belt.

According to a further aspect of the invention, the flexible support member is of a nonconductive, high tear resistance opaque type rubber material.

According to yet a further aspect of the invention, the safety belt has a slotted area in the flexible support member in the outer face which is sized to receive and engage the electroluminescent strip in a manner to expose a light producing portion of the strip within the opening of the slot.

According to yet a further aspect of the invention a reflective member is immediately adjacent the electroluminescent strip to enhance visibility by reflecting both incident light and light produced by the belt.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
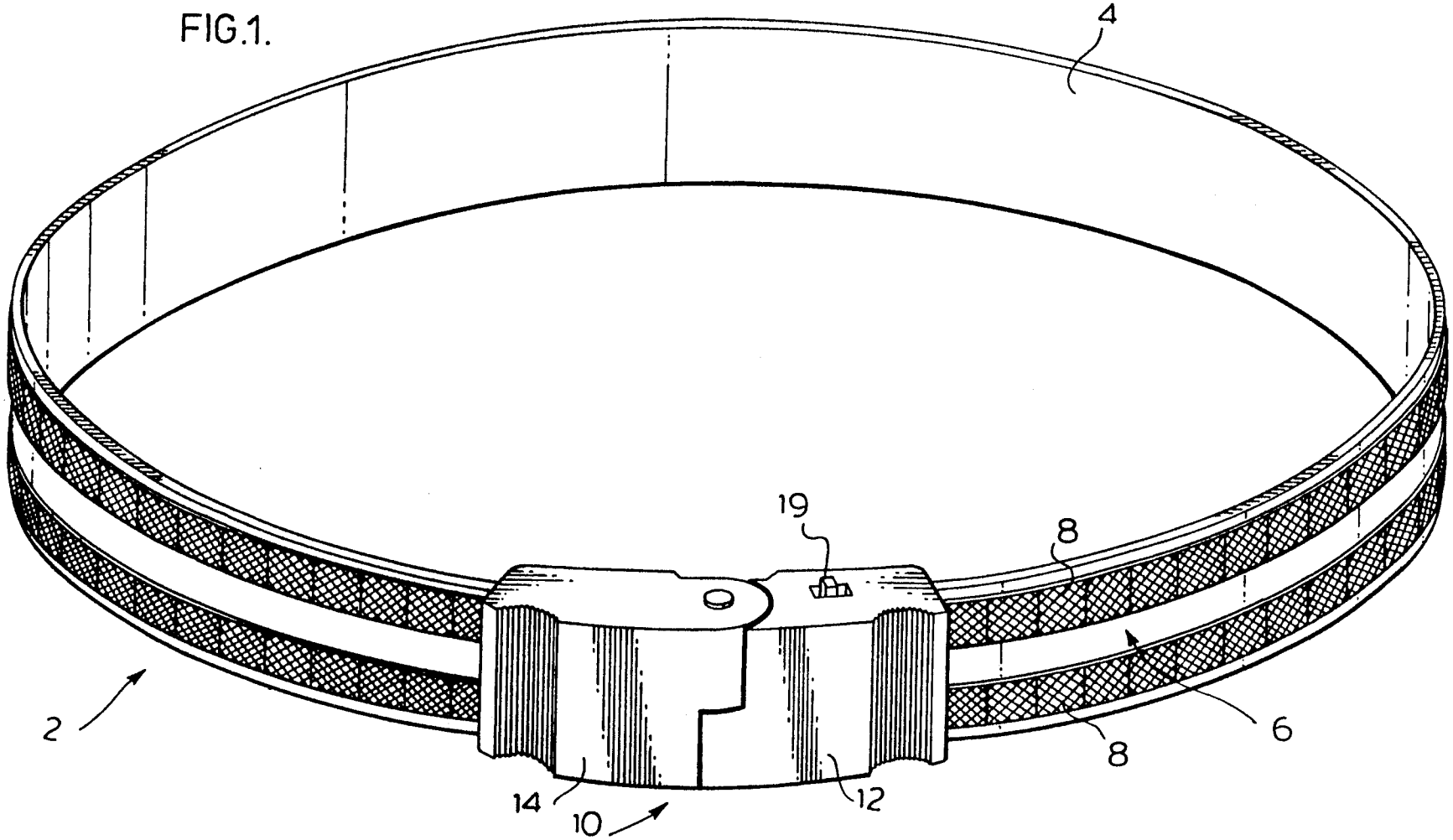
FIG. 1 is perspective view of the safety belt.

The safety belt 2, shown in the drawings, has a flexible support 4 which receives and maintains the electroluminescent strip 6. Reflective strips 8 are located either side of the electroluminescent strip to enhance the function of the belt by acting as a reflecting strip for light contacting the belt from other sources as well as serving as a reflective surface for light illuminating from the electroluminescent strip 6. The belt includes a buckle member 10 having a first buckle part 12 and a second buckle part 14. Parts 12 and 14 are pivotally connected and separate to allow convenient removal of the belt.

Figure 3:
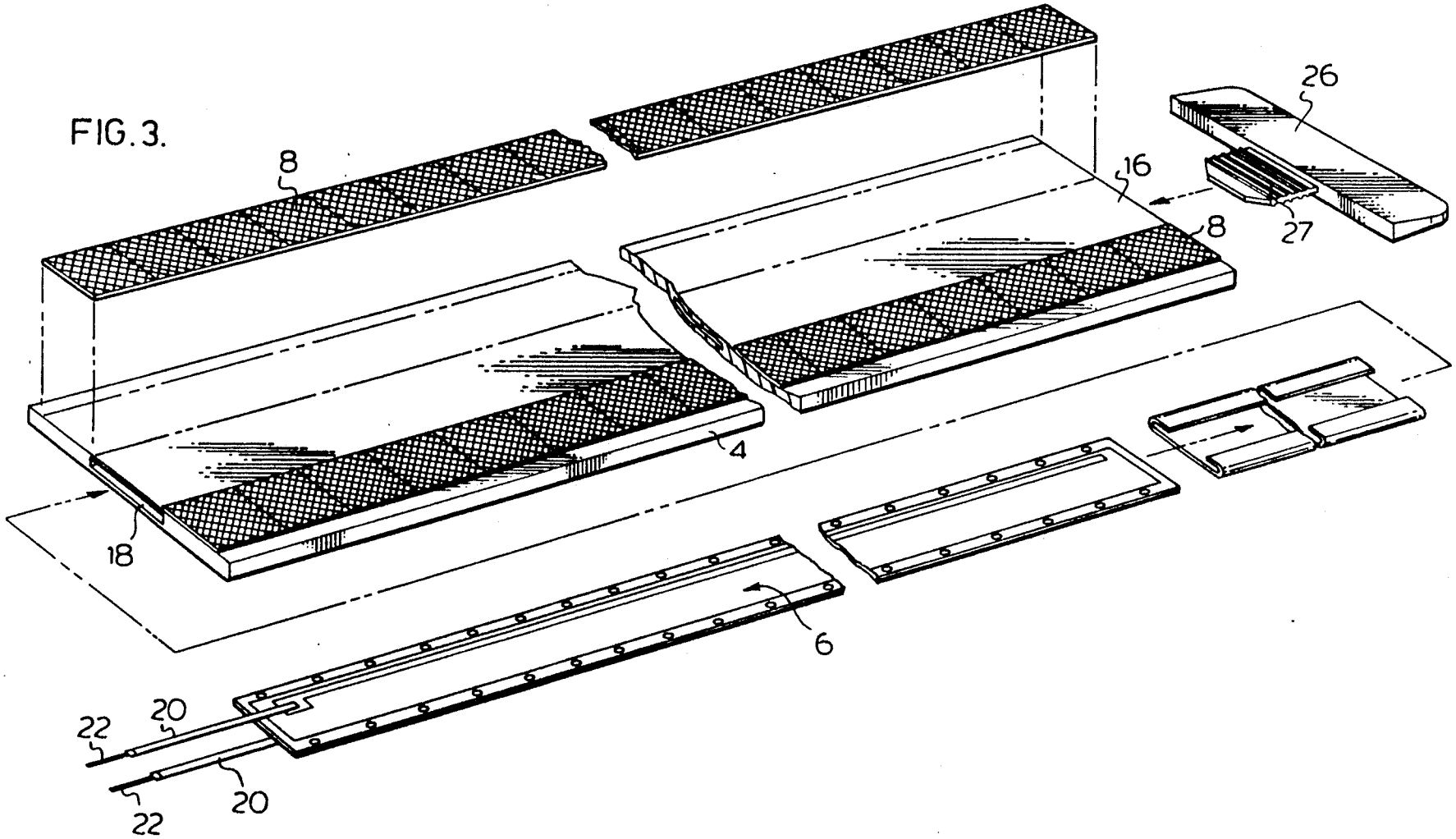
FIG. 3 is an exploded perspective view showing assembly of the portion of the safety belt.

As shown in FIG. 3 the flexible support member 4, which preferably is of a nonconductive, high tear resistance, opaque rubber type material, is extrudeed or cast to have a clear upper surface defining a window 16 covering the pocket 18 into which the flexible electroluminescent strip 6 is inserted. The electroluminescent strip 6 only requires power to be supplied to opposite sides of the strip and thus the electrical leads 20 are provided at one end of the electroluminescent strip for connection with electrical terminals 22 of the electroluminescent strip. The opposite end of the support member 4 is capped by member 26 which includes a projection portion 27 inserted within the pocket 18 and preferably adhered within the pocket. In the case of a cast support 4 the pocket 18 can be blind at one end avoiding the requirement for member 26.

Figure 4:
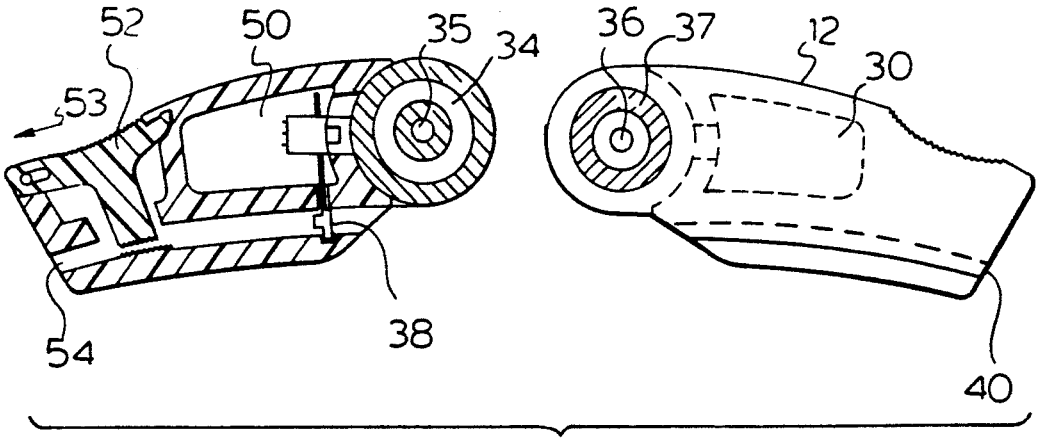
FIG. 4 is a sectional view through the buckle showing various components of the buckle.
Figure 5:
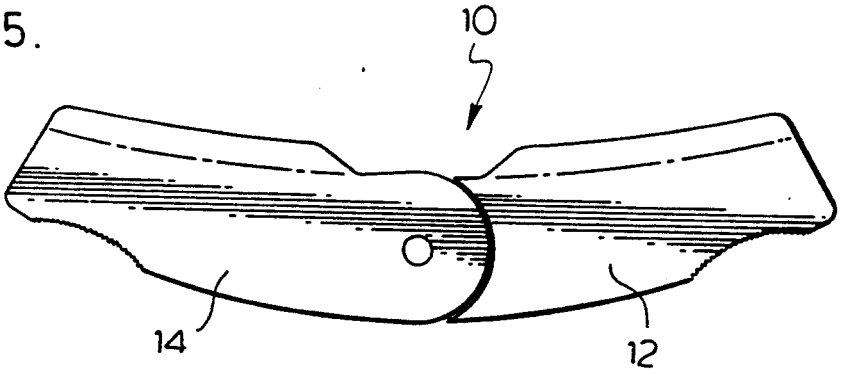
FIG. 5 is a bottom view of the buckle.
Figure 6:
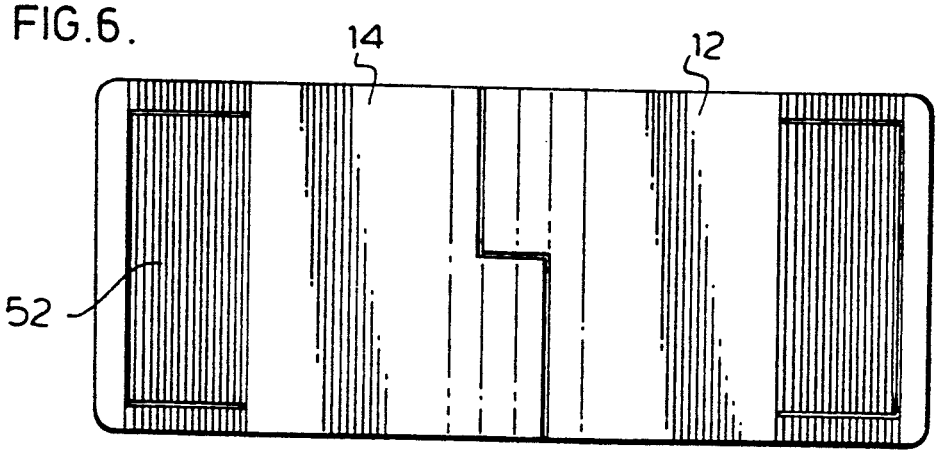
FIG. 6 is a front view of the buckle.

The buckle member 10 as shown in FIG. 4 has a battery 30 provided in the first buckle part 12 which is connected via an electrical two part female connector 36 to electrical two part male connector 35 forming part of the second buckle part 14. The form of the male connector 35 is similar to connector 112 in FIG. 7. Second buckle part 14 receives the one end of the flexible support 4 in combination with the electroluminescent strip and anchors the flexible support with the second buckle part 14. An electrical connection is provided between the electroluminescent strip 6 and the electrical components of buckle part 14 as terminals 22 contact electrical contacts 38 of buckle part 14. This electrical connection remains in place unless the electroluminescent strip has to be replaced. The second buckle part 14 includes electrical circuitry 50 which effectively converts the DC power source of battery 30 into alternating current which will excite the electroluminescent strip. The output of electronic circuitry 50 is feed, via electrical contacts 38, to the electroluminescent strip 6. Such an alternating current excites the material of the electroluminescent strip and causes the same to glow along the length thereof.

The first buckle part 12 includes a battery power supply 30 which is connected to the second buckle part 14 by means of the female and male electrical connections 36 and 35 provided on the buckle parts. Thus, the buckle makes and breaks in the center and has a pivot axis 32 to allow pivoting movement between the first and second buckle parts 12 and 14.The pivot connection is actually formed by means of the male and female electrical connections. An O-ring seal may be provided between grooves 34 and 37 to protect the electrical connections 35 and 36. With this arrangement, there is a mechanical securing of the first and second buckle parts and this mechanical securing effectively connects battery 50 with the electronic circuit 30.

Figure 2:
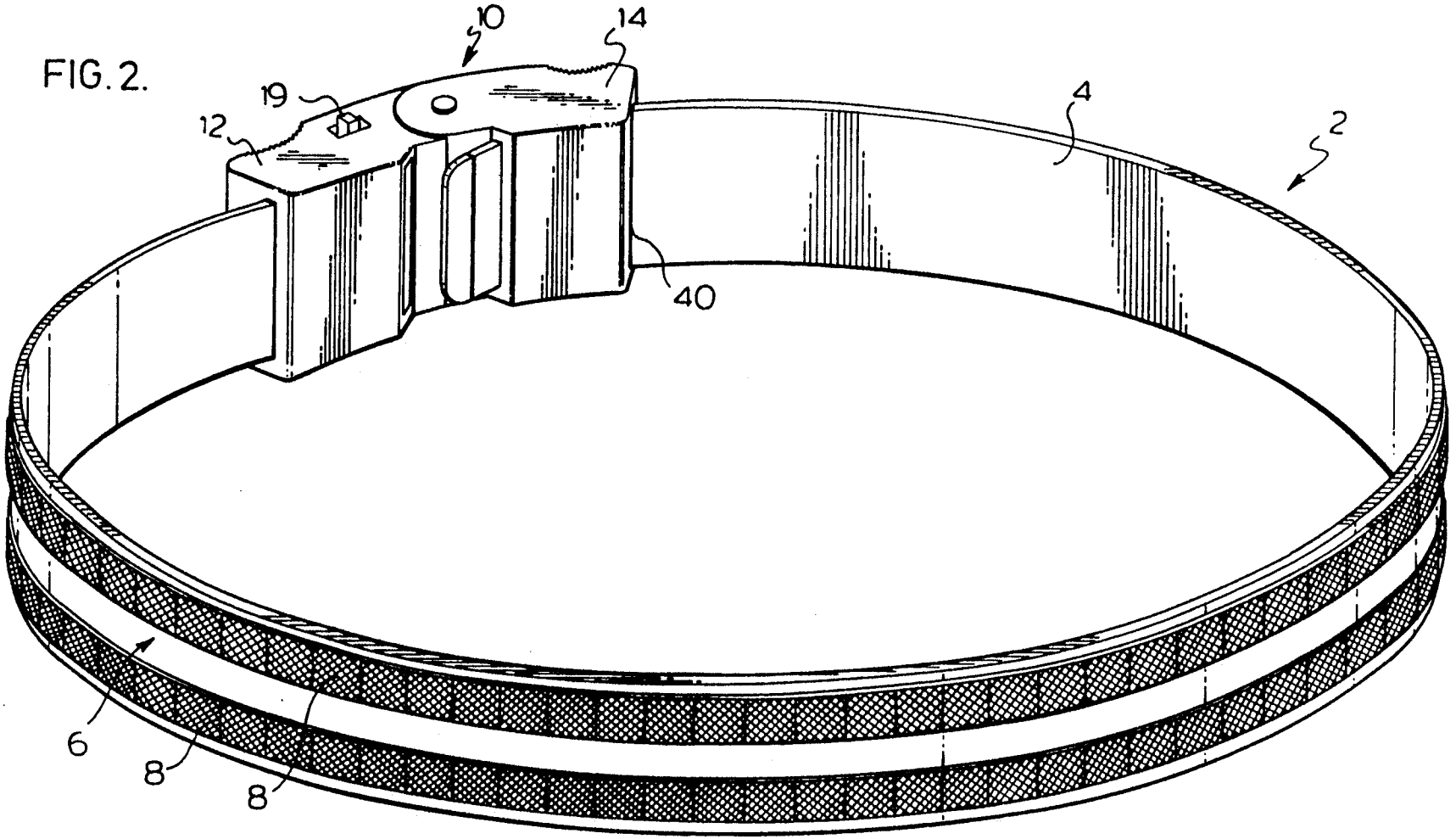
FIG. 2 is a rear perspective view of the safety belt showing the interior of the buckle.

Second buckle part 14 includes an open port 54 through which the electrical connections 22 of the electroluminescent strip 6 and one end of the flexible support member 4 are inserted. Once the member is inserted, the retaining member 52 locks the belt in position. Movement of the belt adjusting member 52 in the direction indicated by arrow 53 releases retaining member 52 and allows flexible support member 4 to freely slide within the port 54, for example to allow replacement of the belt. A similar retaining member is provided in the first buckle part 12 in combination with an open port 40. As can be seen in FIG. 2, the free end of the belt passes through open port 40 and the excess length of the belt is accumulated behind the buckle and behind the opposite end of the belt. Any suitable locking arrangement may be used for adjustably maintaining the belt in port 40. The particular buckle arrangement shown is designed for frequent and demanding use such as may be experienced in police or other security applications. With this arrangement, a continuous ring of light is provided between the buckle providing better visibility. Such an arrangement also simplifies the structure in that the loose end of the belt accumulates behind the belt and buckle and remains generally in position without the need for loops.

The battery 30 is of the rechargeable type and electrical contact 36 co-operates with a rack arrangement(-shown in FIG. 7) such that when the belt is not in use and placed on the rack, electrical contact 36 makes electrical contact with a power supply to allow recharging of the battery 30. In this way, the battery will be fully charged whenever required.

The electroluminescent strips 6 preferably provide a continuous light source around the periphery of the belt between the buckle. There are many sources of electroluminescent strips however the preferred source is manufactured by Luminescent Systems Inc. of New Hampshire. Interrupted light sections can also be provided by custom design of the electroluminescent strip or by blanking portions thereof. The electroluminescent strip may also be stripped for colour or coded in other manners.

The strips are water proof, shock proof, lightweight, durable, flexible, resistant to severe climatic changes and come with a host of electrical connections for different applications.

Figure 7:
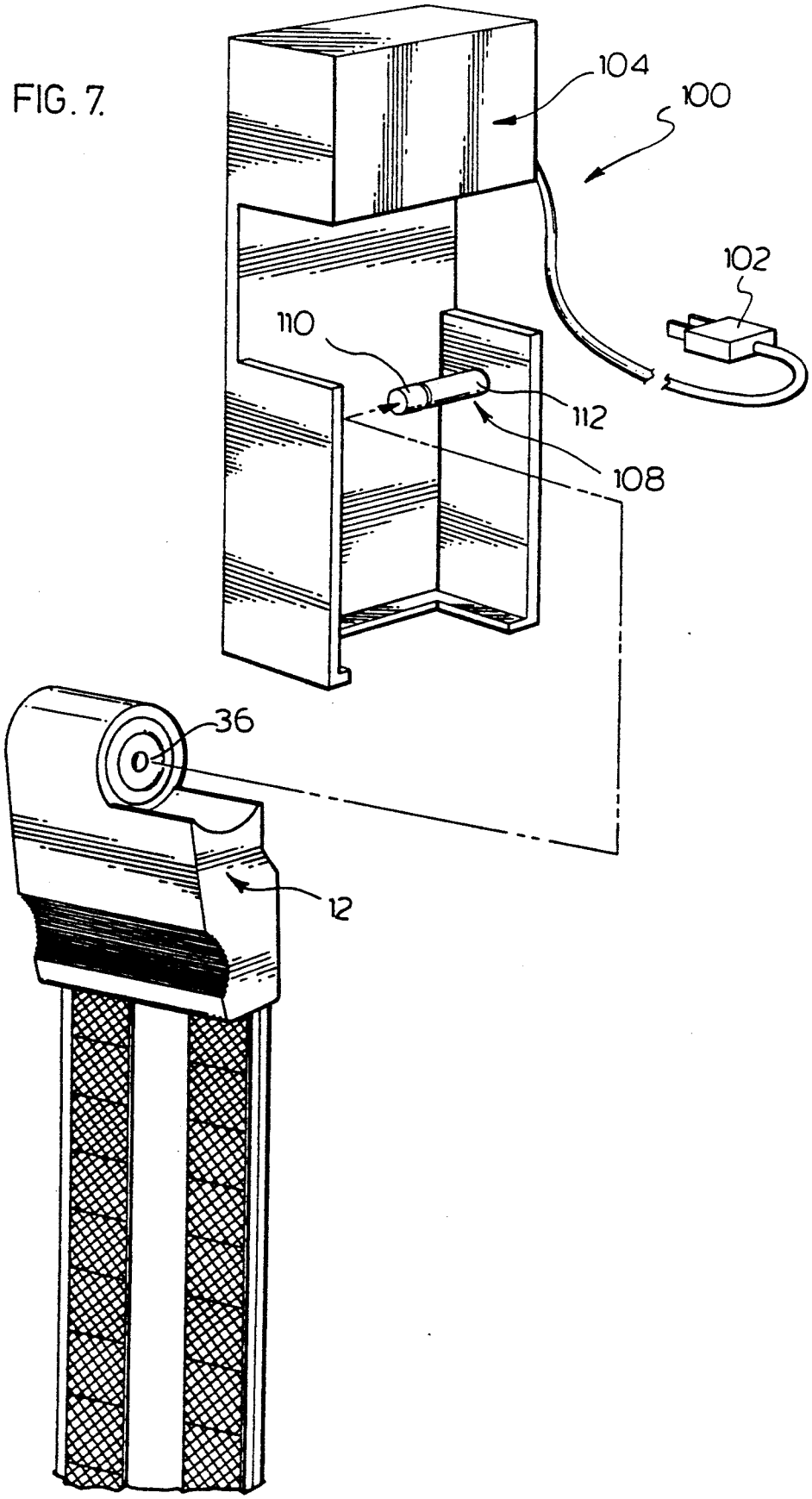
FIG. 7 is a partial perspective view of the belt and a charging arrangement.

The embodiment of FIG. 7 illustrates one arrangement for charging of the battery 30 within buckle part 12. The first buckle part 12 cooperates with the charging rack 100 connected via plug 102 to an AC power source. Convertor 104 transforms the AC power to DC power and is connected to the single probe connector 108.having a positive portion 110 and a negative portion 112. Buckle part 12 includes a corresponding female two contact connector 36 for connecting with probe connector 108 and effecting electrical connection between the battery 30 and the power source. Such an electrical connection is also used between the buckle parts ands allows pivotting of the buckle parts 12 and 14 while maintaining electrical connection therebetween.

Figure 8:
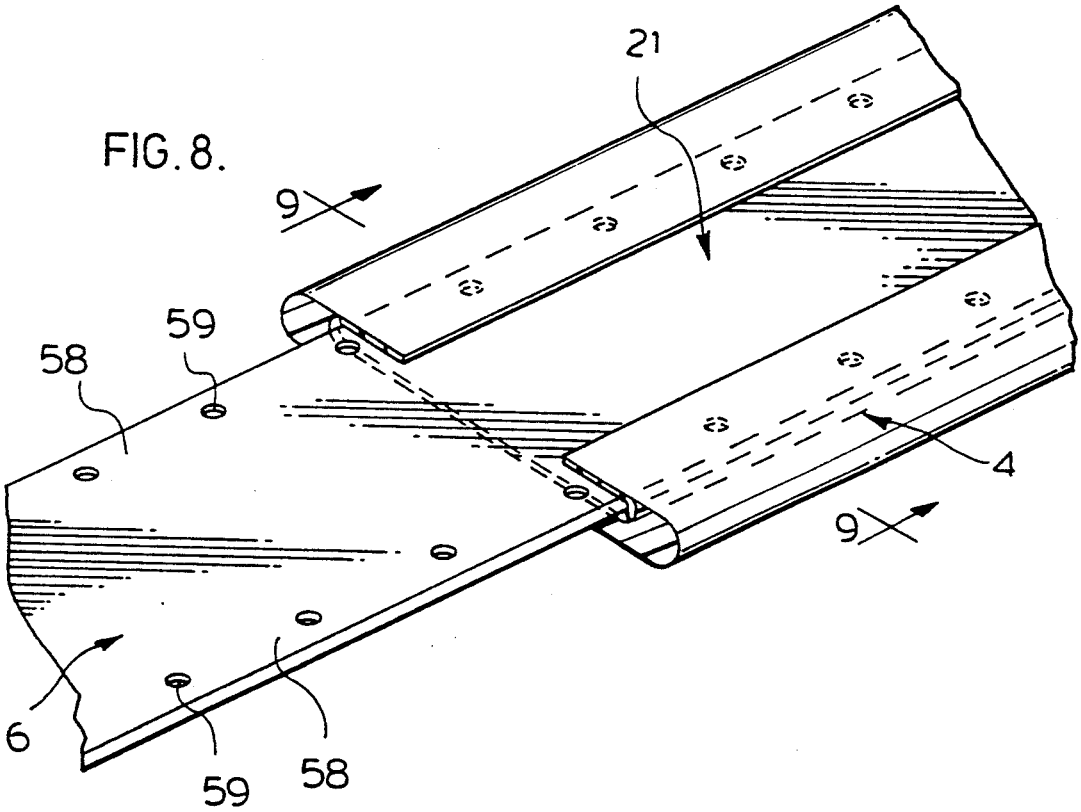
FIG. 8 is a partial perspective view of a different arrangement for securing of the electroluminescent strip.
Figure 9:
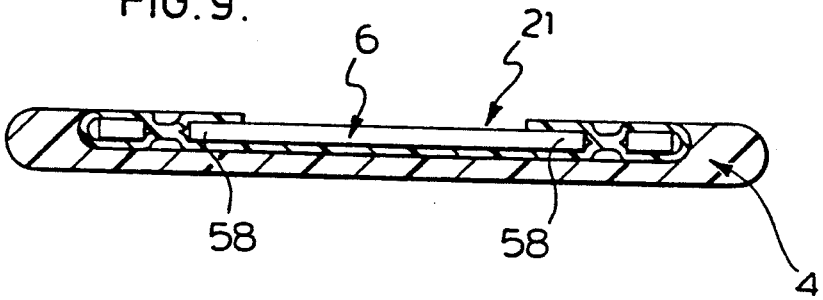
FIG. 9 is a sectional view taken along line 9—9 of FIG. 8.

FIGS. 8 and 9 illustrate a different embodiment where the electroluminescent strip has oversized margin areas 58 having cut out or notched out areas 59. In this case a track can be provided in the flexible support member 4 and the electroluminescent strip 6 inserted within the slot such that the oversized margins 58 are within the open slotted area 21 of the flexible support 4. The nonconductive, high tear resistance rubber type material of the flexible support 4 may then be heated along the slotted region such that a portion of the nonconductive, high tear resistance rubber material of the flexible support 4 extrudes through the cut out portions 59 and subsequently lock the electroluminescent strip to the belt.

The buckle 10 can also include an on/off switch 19 (FIGS. 1 and 2) whereby the electroluminescent strip 6 can be selectively activated. With this arrangement the user only need activate the lighted belt, when required, thus prolonging the actual operation time between battery charging. Switch 19 can also be used to activate a flashing mode, for a different visual effect or for signalling purposes. For certain applications a waterproof switch, such as a magnetic switch, can be used.

It is also possible to provide a simplified version of the lighted belt where the electrical and battery are combined in a single unit. A VELCRO type closure or hook and eye type closure can be used for securing of the belt. Such a simplified belt is less expensive to manufacture and more suitable for the consumer market.

The oversized margins 58 may also be used to mechanically fasten the electroluminescent strip to the flexible support member 4 by stitching or other suitable application. It has been found that the electroluminescent strip itself is difficult to adhere to a flexible support member and therefore these other arrangements for securing of the electroluminescent strip can be used where insertion within a slot or port is not sufficient.

The electroluminescent strips can be manufactured in a plurality of colours to allow for simple colour coding of the belt. Multi-coloured belts can be used to distinguish rank or position. Thus separate coloured regions can easily be manufactured and substitute strips can be inserted in the support 4 if necessary.

Although preferred embodiments of the invention have been described herein detail, it will be understood by those skilled in the art that variations may be made thereto without departing from the spirit of the invention or the scope of the appended claims.

The embodiments of the invention in which an exclusive property or privilege is claimed are as follows:

1. A safety belt comprising a flexible support member forming the body of the belt, a continuous electroluminescent flexible strip extending substantially the length of the belt and exposed to one side of the belt, power supply means connected to said electroluminescent flexible strip for exciting the same, and means for securing said belt at various positions wherein said flexible support member has a slotted area in the outer face thereof sized to receive and engage said electroluminescent strip in a manner to expose a light producing portion of said strip within the opening of said slot.

2. A safety belt as claimed in claim 1 wherein said power supply means and said means for securing are combined in a single buckle member.

3. A safety belt as claimed in claim 2 wherein said buckle member is divided into two parts, the first part including a battery storage arrangement and a second part including electrical circuitry for converting DC power into an alternating current.

4. A safety belt as claimed in claim 3 wherein said buckle member splits between said two parts to allow release of said belt and said two parts include releasable electrical connections therebetween.

5. A safety belt as claimed in claim 4 wherein said second part maintains a continuous electrical connection with said belt regardless of the connection between said first and second parts.

6. A safety belt as claimed in claim 4 wherein said electroluminescent strip when activated radiates two different colours of light.

7. A safety belt as claimed in claim 6 wherein said electroluminescent strip is divided longitudinally into two distinct regions emitting different colours of light.

8. A safety belt as claimed in claim 2 wherein said second part of said buckle member includes releasable grip means for engaging said support member.

9. A safety belt as claimed in claim 8 wherein excess length of said support member is accumulated behind said buckle member.

* * * * *